United States Patent [19]

Kilner

[11] 4,373,670

[45] Feb. 15, 1983

[54] APPARATUS FOR APPLYING ROAD MARKING MATERIALS TO ROADWAYS

[75] Inventor: David N. Kilner, Horsham, England

[73] Assignee: Prismo Universal Limited, Surrey, England

[21] Appl. No.: 288,334

[22] Filed: Jul. 30, 1981

[30] Foreign Application Priority Data

Jul. 30, 1980 [GB] United Kingdom ..... 8024894

[51] Int. Cl.[3] ..... B05B 1/20; A01G 25/09; E01C 19/16; E01H 3/02

[52] U.S. Cl. ..... 239/172; 239/176; 118/305; 404/15; 404/73; 404/93; 404/94; 427/137

[58] Field of Search ..... 404/15, 73, 94, 93; 427/137; 118/305; 239/150, 151, 172, 176

[56] References Cited

U.S. PATENT DOCUMENTS

| | | | |
|---|---|---|---|
| 3,086,431 | 4/1963 | Perry | 94/39 |
| 3,421,476 | 1/1969 | Mattos | 118/8 |
| 3,477,352 | 11/1969 | Harding et al. | 404/94 |
| 3,540,358 | 11/1970 | Oakley | 94/39 |
| 4,136,991 | 1/1979 | Clark et al. | 404/73 |
| 4,256,261 | 3/1981 | Gurney | 239/150 X |

FOREIGN PATENT DOCUMENTS

| | | | |
|---|---|---|---|
| 1923877 | 11/1970 | Fed. Rep. of Germany . | |
| 2119076 | 10/1972 | Fed. Rep. of Germany | 427/137 |
| 946541 | 1/1964 | United Kingdom . | |

*Primary Examiner*—Michael R. Lusignan
*Attorney, Agent, or Firm*—Young & Thompson

[57] ABSTRACT

A vehicle (10) carries an ejector means (17) which is mounted for reciprocating movement on the vehicle and is operable to eject discrete blobs of a viscous road marking material onto a road surface to be marked. The ejection means is arranged to move relative to the vehicle during ejection of the blobs so that its outlet moves at approximately the same speed as the vehicle and in the opposite direction, the arrangement being such that the speed of the blob relative to the roadway is approximately zero.

6 Claims, 6 Drawing Figures

APPARATUS FOR APPLYING ROAD MARKING MATERIALS TO ROADWAYS

This invention is concerned with the application of road marking materials to roadways and is particularly concerned with an apparatus for applying such materials to produce raised road markers (a) on the surfaces of roadways or on the surfaces of an existing marking on roadways or (b) in combination with markings applied by the apparatus, or other apparatus, ahead of or behind the raised road markers applied by said apparatus.

Where used herein the term "roadway" is intended to include highways formed of concrete, tarmacadam, etc., airport runways and like surfaces on which vehicles travel. The term "existing markings" is intended to include existing lines painted on a road surface and lines provided by preformed tapes or sheets of plastic material.

One of the major problems of road markings is that of achieving and maintaining their retroreflective characteristic, i.e., the amount of light reflected by the markings from incident light falling thereon from car headlights, etc.

Lines painted by various means, spray apparatus etc., or preformed lines bonded to the surface of a road have in the past been provided with glass microspheres to add to the retroreflectivity characteristic. The performance of the road markings is enhanced and the markings show up clearly in the headlights of approaching vehicles to the benefit of the driver and other road users.

Even though known road markings have adequate retroreflectivity in the dry, when it is wet there is a marked decline in this important characteristic.

Several attempts have been made to further enhance the retroreflectivity of painted lines and preformed markings. For example, it is claimed in Canadian Pat. No. 1,072,384 that a combination of painted line interposed with strips or webs of prefabricated multilayer tape material gives surprisingly good results in respect of retroreflectivity. Compared with a painted on line the said results are claimed to be greatly superior while being not noticeably less than those obtained from a line formed wholly of preformed tape material. However, such an arrangement is too costly for general applications.

In U.S. Pat. No. 3,958,891 the use of preformed resin bodies coated with retroreflective beads are proposed for use with a tape or a painted line. In either case, although the enhancement aimed for appears to be achieved it is only as a result of off-site manufacture of the preformed bodies and tapes, and this is also costly.

In one further embodiment proposed in U.S. Pat. No. 4,136,991 a series of raised road markers are provided on a road surface by an apparatus incorporating means for moulding a measured quantity of resin material including reflective glass beads and/or pigment to form a road marker which is thereafter deposited on the road surface to delineate traffic lanes. One drawback of such an arrangement is that it includes moulding trays for receiving the resin material and feed mechanism for feeding the trays filled with resin to the road surface. The provision of such devices adds to the complexity of the arrangement and to the overall cost of the apparatus.

The present invention provides apparatus for applying road marking material to a trafficable surface of a roadway and comprising a vehicle, an ejector mounted on the vehicle and operable to deliver discrete blobs of a fluid road marking material directly onto the surface from a delivery port of the ejector means and means for moving the ejector means relative to the vehicle at least during ejection so that, in use, when the vehicle is propelled along a roadway the speed of the delivery port relative to the roadway during delivery of the blobs is reduced.

Preferably the moving means comprises a ram connected to the ejector means.

Preferably the ejector means comprises a tubular chamber, open at one end to provide the delivery port and valve means for opening and closing the delivery port.

The ejector means may be pivoted relative to the vehicle for movement about an axis spaced from the delivery port.

The ejector means is preferably pivotally mounted on a bracket which is in turn pivotally mounted on the vehicle. The ram is preferably connected between the ejector means and the bracket.

Control means may be provided for reciprocating the ram so that the delivery port of the ejector means moves rearwardly relative to the vehicle during delivery of the blobs at approximately the same speed as the vehicle is moving forwardly.

The control means may be operated by a synchronising means whereby the ejector means is moved to an ejection position in response to triggering of the synchronising means.

Preferably the synchronising means is triggered after the apparatus has travelled a predetermined distance whereby movement of the ejection means to its ejection position and ejection of blobs of road marking material onto the trafficable surface takes place at designated intervals.

In one convenient arrangement triggering of the synchronising means may be in response to the detection of a previously applied road marking, and the detection of a previously applied road marking may be by photoelectric devices of the like. Filters may be provided to prevent premature operation of the photo-electric devices by glare.

The apparatus of the present invention may also comprise one or more of the following devices:

i. a batching means for measuring successive blob forming quantities of road marking material;

ii. a dryer for blow drying and removing dust from a road surface in advance of the blob ejection means;

iii. an applicator for applying a continuous marking to the road surface ahead of or to the rear of the ejection means; and, iv. an applicator for applying glass beads to a just applied blob and/or marking.

The raised road markers deposited by the apparatus described above may each comprise a measured blob of a substantially liquid road marking composition which when ejected on to the surface dome shaped road marker and then set solid.

The road marking composition may be based on a hot applied thermoplastic resin or a thermo setting resin.

Preferably the road marking composition is formulated so that the dome shaped marker blob does not slump out of shape before the material has set. This may conveniently be achieved by ensuring that the material has an adequate level of thixotropy. Preferably the road marking composition is also chosen so that it sets to a solid speedily after application to the road surface in order that a long period of protection by road cones is avoided.

In the case of a thermoplastic resin based composition, the resin may have sharpely defined melting characteristics in order to give the required speed of setting.

Conveniently the thermoplastic resin may be a polyamide resin. Conveniently the polyamide resin road marking composition may be heated to between a temperature of 120° and 240° C., preferably to between 130° and 200° C. and in one embodiment to 180° before ejection onto a road surface. The thermoplastic road marking composition may be a mixture of 8 to 25% by weight of polyamide resin, 3 to 18% by weight of titanium dioxide, 5 to 25% by weight of whiting, 15 to 40% by weight of glass beads, the remainder being wear-resistant and/or reinforcing filler materials and additives in sufficient quantities to control the thixotropic, fluid and anti-settling characteristics of the composition.

The above composition gives a white coloured raised marker, but other pigments or colourants may be used in place of the titanium dioxide where markers of different colours are required.

The road marking composition may alternatively be based on a thermo setting resin such as acrylic, epoxide or polyester.

The composition may be based on a fast setting acrylic composition as disclosed in U.S. Pat. No. 4,076,671.

In one example using the apparatus of the invention, a series of markers of 70 to 90 mm diameter and of 6 to 10 mm dome height were provided on a road surface which markers were trafficable within two minutes of application to the road surface.

There now follows, by way of example, a detailed description of a preferred embodiment of apparatus for applying road marking material to a roadway to form raised road markers which description is to be read with reference to the accompanying drawings, in which.

Figure 1:
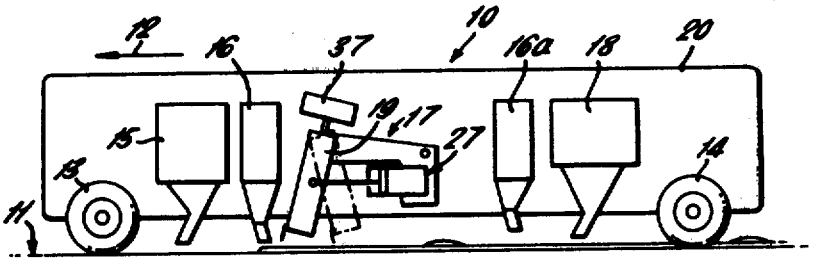
FIG. 1 is a diagrammatic representation of apparatus for applying road marking material according to the invention.

In the past there have been many developments in road markings in order to enhance the retroreflective characteristic of such markings.

Those have included the use of combinations of glass beads and raised markers wherein the raised markers are provided by individual elements manufactured off-site and transported to the locations where they are to be used. This in itself is a major disadvantage in that capital investment in manufacturing plant, storage and transport have to be met.

Raised markers formed by callendering devices have also been suggested for modifying the thickness of a ribbon of marking material applied to a road surface to give a marking comprising raised ridges.

Other raised markers in combination with preformed webs of plastic material have also been suggested.

The apparatus described below provides a simple and convenient way of providing raised road markers.

Referring now to the drawings, the apparatus comprises a vehicle 10 which is propelled along a road surface 11 in the direction of the arrow 12 on wheels 13 and 14. Such a vehicle is preferably operated at speeds of 100 to 300 meters per minute. The vehicle 10 has mounted thereon a blower dryer 15 of known type whereby a road surface may be cleared of debris, i.e., dust and loose road stones, a spray applicator 16, a raised marker ejector device 17 a second spray applicator **16*a* and a bead applicator 18**.

Figure 5:
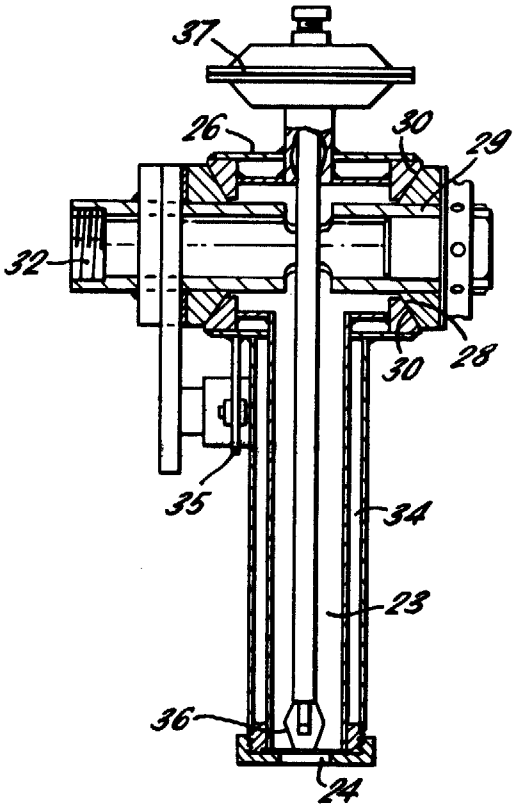
FIG. 5 is a section along the line 5—5 of FIG. 4.
Figure 4:
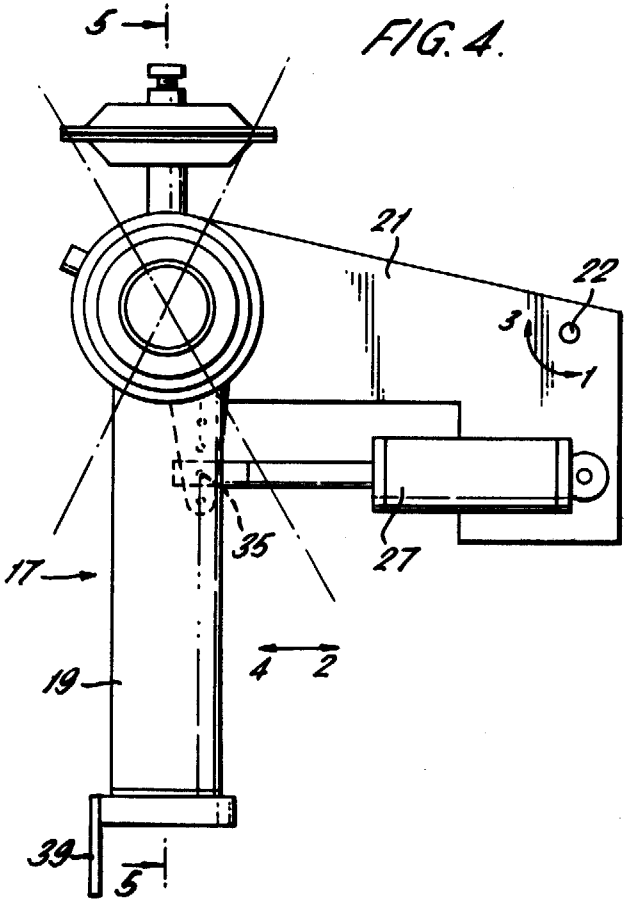
FIG. 4 is an enlarged view of a road marking material ejector of the apparatus of FIG. 1.

The ejector device 17 will now be described in more detail with reference to FIGS. 4 and 5.

The device 17 comprises a tubular housing 19 which is pivoted on a bracket 21 which is in turn pivoted to the chassis 20 of the vehicle at 22. The housing 19 has an elongate cylindrical chamber 23 having a discharge orifice 24 at one end and an annular collar 26 at its other end. The collar 26 includes frusto-conical bearing surfaces 28 in the form of PTFE glands. A tube 29 extends through the collar 26 and is secured thereto by frusto-conical shoulders 30 which seal against the glands 28 while allowing rotation of the housing 19 relative to the tube 29. An inlet end 32 of the tube 29 is connected to a central supply tank (not shown) so that road marking material under pressure may be supplied to the chamber 23. The road marking material so supplied is at a temperature of approximately 150° C. and an oil jacket 34 is provided surrounding the chamber 23 to maintain the material at that temperature.

A ram 27 is connected between the bracket 21 and a flange 35 fixed to the housing 19 for pivoting the housing. A plate 39 which forms an adjustment member, extends from the housing 19 below the nozzle.

When the vehicle 10 is traversing a road surface to which raised markers are to be applied, the housing 19 can be swung rearwardly, see FIG. 1, to cause the relative speed between the discharge orifice 24 and the road surface 11 to be reduced to zero, or substantially so; thus, at the instant of ejection of a blob of marking material from the chamber 19 onto the road surface, there are no undue forces acting on the blob of material to cause unnecessary deformation thereof. In use, the first movement of bracket 21 takes place in the direction of arrowhead 1. When the leading edge of the adjustment member 39 attached to the lower end of housing 19 engages the road surface, the pivoting movement of bracket 21 ceases and ram 27 is operated to swing the cylinder 19 in the direction of arrow 2 (FIG. 4). The blob of marking material is ejected during this movement.

The bracket 21 is then returned to its starting position (in the direction of arrow 3) prior to the return stroke of the ram 27 thereby raising the housing 19 away from the road surface before returning it to its initial position by movement of ram 27 in the direction of arrow 4.

The discharge orifice 24 is closed off by an ejection valve 36, operable by a diaphragm piston 37 associated therewith and mounted on an upper end of the housing 19, see FIG. 1.

Figure 6:
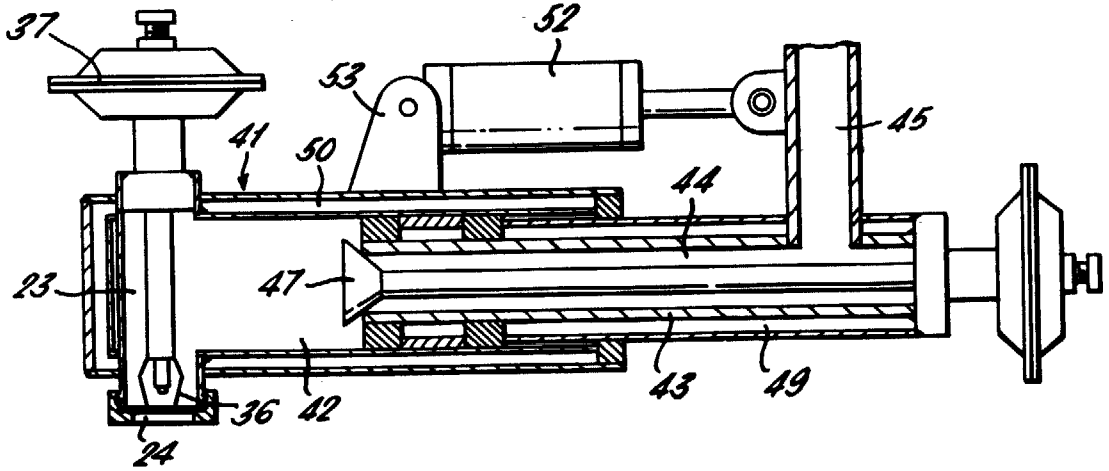
FIG. 6 is a section through an alternative form of ejection.

An alternative embodiment of ejector device 40 is shown in FIG. 6. In this embodiment a chamber 23 having a discharge orifice 24 closed off by a valve 36 operated by a diaphragm piston 37 forms part of an elongate housing 41 arranged generally horizontal and movable relative to the vehicle in a sliding rather than pivoting manner. The housing 41 includes a cylinder part 42 in which a hollow piston 43 slides. The piston 43 has a central bore 44 through which road marking material is fed from an inlet pipe 45 and a diaphragm piston operated valve 47 closes off the bore 44. Both the piston 43 and housing 41 have oil jackets 49, 50 respectively for maintaining the temperature of the road marking material.

The inlet pipe 45 and piston 43 are fixed relative to the vehicle and a ram 52 is connected between the inlet pipe and a bracket 53 on the housing 41. Reciprocation of the ram moves the discharge orifice 24 relative to the vehicle as described above with reference to FIGS. 1, 4 and 5 and also effects a pumping action of the piston 43 to feed road marking material under pressure to the chamber 23.

Figure 2:
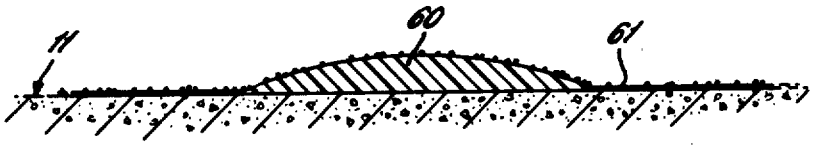
FIG. 2 is a diagrammatic section view of a raised road marker applied to a trafficable surface of a roadway by the apparatus of FIG. 1.
Figure 3:
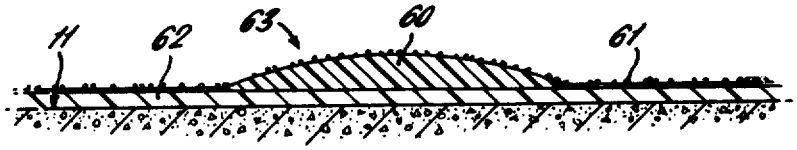
FIG. 3 is a section view of a raised marker applied to a just sprayed on line of marking material.

In use the vehicle 10 is driven along the road surface 11 in the direction of the arrow 12 as aforesaid and the formation of road marking comprising raised markers can be as follows:

(a) successive blobs of road marking material are ejected from the chamber 23 onto the road surface 11 to form a series of domed shaped road markers 60, see FIG. 2, to which a sprayed line of road marking material and/or glass beads 61 may be applied by the applicators 16*a* and 18;

(b) successive blobs of road marking material are ejected from the chamber 23 onto a line of marking material applied by the spray applicator 16 to form a marking 62 having raised areas 63, see FIG. 3, to which a sprayed line of road marking material and/or beads 61 may be applied from the applicators 16*a* and 18;

(c) successive blobs of road marking material are ejected from the chamber 23 onto a web of preformed plastics marking material fed by means not shown onto the road surface 11, the blobs becoming adhered to the plastics marking material to form a marking similar to the marking 62 of FIG. 3. Glass beads can thereafter be applied from the applicator 18 to part or all of the marking so provided; however, appropriate means of bonding the beads to the plastics marking material may have to be provided.

(d) blobs of road marking material are ejected from the chamber 23 onto existing road markings to enhance the retroreflectivity of such markings and a sprayed line of road marking material and/or beads 62 may be applied from the applicators 16*a* and 18.

Application of the blobs of marking material to the road surface 11 or other markings is controlled by synchronising means, not shown.

The synchronising means in one embodiment includes means for activating the ejection means whereby blobs are ejected from the chamber 23 onto the road surface 11 or other road marking at designated intervals.

In the cases where existing road markings are to be up-graded a photo-electric detection means, not shown, is used to detect the existing markings and trigger-off the synchronising means to cause operation of the ejection means to eject blobs of marking material at designated intervals as aforesaid.

The composition of the road marking material from which the raised road markers are made is one which has excellent wear and anti-soiling characteristics and is a polymer resin of one polyamide type.

One example of the polyamide resin based composition which has been found to be particularly effective contains:

(a) 14% by wt. of polyamide resin having a softening point of 110° C;

(b) 4% by wt. of a commercial grade of stearamide;

(c) 10% by wt. of titaniumdioxide pigment;

(d) 10% by wt. of whiting;

(e) 25% by wt. of glass beads, of 400 to 1000 diameter; and, (f) 37% by wt. of crushed dolomite.

Another example of a suitable composition is:

(a) 16.4% by wt polyamide resin;

(b) 4.6% by wt maleic condensate resin esterified with glycerol;

(c) 15% by wt of titanium dioxide;

(d) 7.5% by wt of whiting;

(e) 20% by wt of glass beads;

(f) up to 35% by wt of wear resistant material, viz. aggregates; and (g) 1 to 1.5% by wt of an organic derivative of magnesium montmorillonite.

Small amounts of other constituents to give the required thixotropy, viscosity and anti-settling quality to the composition may be added.

Raised road markers 30 have been formed, see FIG. 2, which are some 70 to 90 mm in diameter and from 6 to 10 mm dome height.

It is not considered practicable to make larger diameter markers without sacrificing some of the dome shaped character of the markers.

The material from which the markers are made may be any suitable polymer or resin e.g. polyester or the material could be a modified styrene copolymer, i.e. an alpha methyl styrene or vinyl toluene. Although titanium dioxide is added it is obvious that other pigments may be chosen to give markers of various colours.

Using the raised road markers formed as described above it has been found that they have:

(i) improved retroreflectivity when compared with planar markings;

(ii) improved wet night visibility;

(iii) improved water shedding properties; and, (iv) improved anti-soiling.

It is to be appreciated that the temperature to which the road marking material requires to be raised will depend on the composition of the material, i.e. the temperature range given for a polyamide based composition would not necessarily be the same for another composition. It is envisaged that the raised road markers may be deposited on a road surface, seriatim as herein described or they may be laid in any convenient staggered or off-set pattern to suit the requirement of the application, e.g. two or more markers may be laid side by side across the width of a tape or sheet. Where markers are laid in this way the size of the marker may be reduced if the size of the tape or sheet makes it necessary.

The apparatus described above has a number of advantages which will be apparent from the description. Some of these are:

(a) there is no need for adhesive to bond the markers to the road surface.

(b) there is no need to shape or preform the blobs.

(c) the size and profile of the blobs can be varied by control of the valve of the ejector.

(d) the colour of the markers can be changed by adding pigments to the material mix.

I claim:

1. Apparatus for applying road marking material to a trafficable surface of a roadway comprising a vehicle, ejector means mounted on the vehicle and operable to deliver discrete blobs of a fluid road marking material directly onto a said surface from a delivery port of the ejector means, and a ram connected between the ejector means and a part of the vehicle for moving the ejector means relative to the vehicle during ejection so that, in use, when the vehicle is propelled along a roadway the speed of the delivery port relative to the roadway during delivery of the blobs is reduced.

2. Apparatus as claimed in claim 1 in which control means are provided for recriprocating the ram so that the delivery port of the ejector means moves rearwardly relative to the vehicle during delivery of the blobs at approximately the same speed as the vehicle is moving forwardly.

3. Apparatus as claimed in claim 1 in which the ejector means comprises a tubular chamber open at one end to provide the delivery port and valve means for opening and closing the delivery port.

4. Apparatus as claimed in claim 3 in which the ejector means is pivoted relative to the vehicle for movement about an axis spaced from the delivery port.

5. Apparatus as claimed in claim 4 in which the ejector means is pivotally mounted on a bracket which is in turn pivotally mounted on the vehicle.

6. Apparatus as claimed in claim 5 in which the ram is connected between the ejector means and the bracket.

* * * * *